United States Patent [19]

Riley

[11] Patent Number: 4,543,012

[45] Date of Patent: Sep. 24, 1985

[54] BARRIER FOR FLOATING POLLUTANTS

[75] Inventor: Victor Riley, Toronto, Canada

[73] Assignee: Canadian Patents and Development Limited, Ottawa, Canada

[21] Appl. No.: 572,832

[22] Filed: Jan. 23, 1984

[30] Foreign Application Priority Data

Feb. 25, 1983 [CA] Canada ..... 422466

[51] Int. Cl.[4] ..... E02B 15/04

[52] U.S. Cl. ..... 405/71; 405/72

[58] Field of Search ..... 405/63–72

[56] References Cited

U.S. PATENT DOCUMENTS 3,685,297 8/1972 Juodis et al. ..... 405/72 X 4,388,188 6/1983 Morris ..... 405/72 X

*Primary Examiner*—David H. Corbin

*Attorney, Agent, or Firm*—Ronald G. Bitner

[57] ABSTRACT

A simple barrier of the type having a series of buoyant tubular sections interconnected by a central cable and provided with a depending skirt. A portion of the skirt that is not attached at the joints is adapted to form an upwardly directed channel which effectively prevents the passage of pollutants through the openings at the joints without the necessity of directly sealing the openings.

5 Claims, 2 Drawing Figures

BARRIER FOR FLOATING POLLUTANTS

BACKGROUND OF THE INVENTION

This invention relates to a deployable barrier for confining floating pollutants, such as oil.

Barriers are known which comprise a series of buoyant boom sections interconnected by a cable, or the like, passing longitudinally therethrough and provided with a depending flexible skirt.

One of the difficulties encountered with the above mentioned construction is the prevention of leakage at the joints between sections, particularly in flowing water or when being towed. To allow free pivoting of the boom sections relative to one another, some clearance between sections is required. Furthermore, when boom sections are not individually attached to the cable, the clearances will not always remain evenly distributed, but rather tend to accumulate between some of the sections to form large gaps, particularly under the force of moving water. Because of the variations in gap size between boom sections, it is very difficult to prevent the leakage of pollutants, not only because of the gap itself but also because of the difficulties in maintaining sealed attachment between the skirt and boom in the region of the variably spaced joints.

Prior proposals to prevent separation and/or leakage at the joints involve adding substantial complexity and cost to boom construction.

Another difficulty with conventional barriers is that, as the relative velocity of the barrier to water is increased, due to towing and/or flowing water, there is a point, known as the first-loss speed, at which water passing under the skirt entrains oil causing it to pass under the barrier.

SUMMARY OF THE INVENTION

It has been found that the leakage of pollutants can be avoided without adding substantially to the complexity of construction. Specifically, it has been found that a non-attached portion of the skirt, at each joint, can be utilized to form a channel in the skirt that directs the flow of water in such a way so as to prevent the loss of floating pollutants without the necessity of directly sealing the openings. It was further found that this arrangement also provides a higher first-loss speed.

The present invention provides a barrier for confining floating pollutants comprising:

a plurality of buoyant tubular boom sections serially interconnected by a cable passing longitudinally therethrough, a flexible skirt, having an upper edge portion and lower edge portion, means attaching the upper edge portion to the skirt to a lower portion of the boom sections, and defining a non-attached edge portion between boom sections, a lower cable member attached to the lower edge portion of the skirt, said non-attached edge portion of the skirt forming an upwardly oriented channel, operative, with water passing between the booms and non-attached portion of the skirt, to channel water upwardly from below the surface, restricting the passage of floating pollutants.

DESCRIPTION OF PREFERRED EMBODIMENTS

Figure 1:
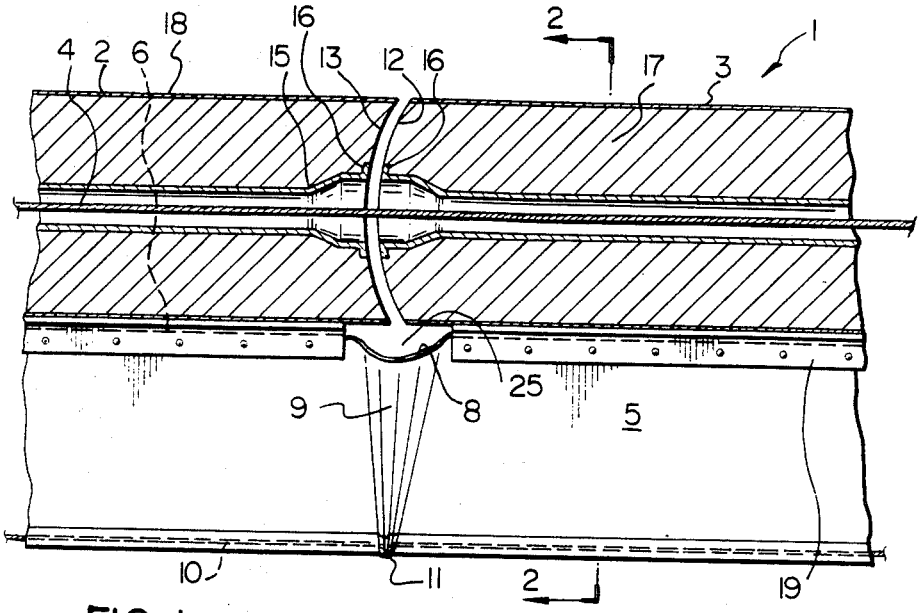
FIG. 1 is a partly sectioned elevation of a barrier in accordance with the present invention showing portions of two adjoining boom sections.
Figure 2:
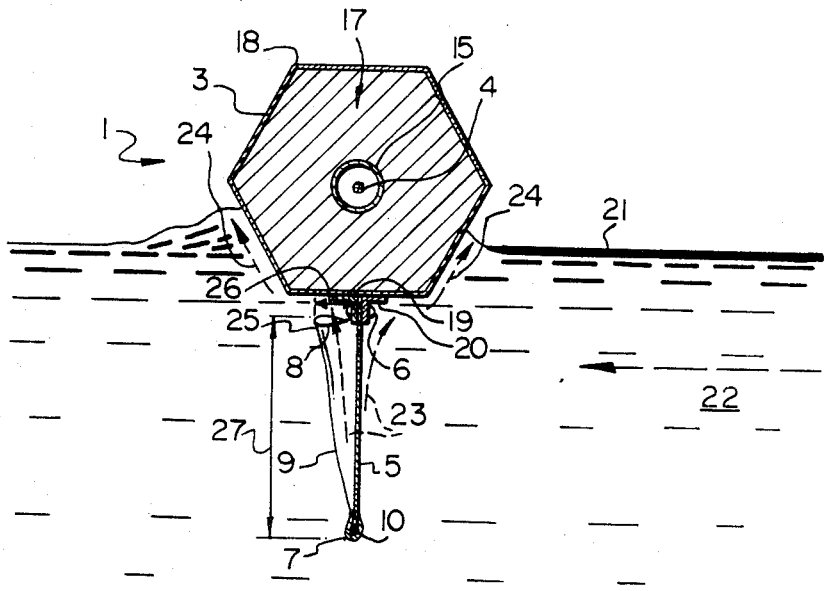
FIG. 2 is a sectional view of the barrier taken at 2—2 of FIG. 1.

With reference to FIGS. 1 and 2, the barrier 1 of the present invention comprises buoyant tubular boom sections 2 and 3 interconnected by a cable 4 passing longitudinally therethrough. Depending from the boom sections is a flexible skirt 5 which has an upper edge 6 and lower edge 7. The upper edge 6 is attached to the boom segments 2 and 3 throughout its length except for a portion at the joints, which defines a non-attached edge portion 8. The non-attached edge portion 8 forms an opening 12, between the skirt 5 and the boom joint, through which water may pass. With water flowing relative to the barrier, or when being towed, the force of water against the skirt 5 will cause the non-attached portion to be pushed outward to form a vertically oriented channel 9. The lower edge 7 of the skirt is attached to a lower tensioning cable 10.

Referring specifically to FIG. 1, the ends 12 and 13 of boom sections 3 and 2, respectively, are provided with complementary ball (12) and socket (13) elements to facilitate alignment and pivoting of the boom sections.

The boom sections may be constructed in various ways. With reference to the drawings, the preferred construction includes a central tubular reinforcing member 15 through which the cable 4 passes and which has radially extending flanges 16 at both ends to provide impact resistance for the adjoining boom sections. Surrounding the tubular member is the buoyant material 17, such as a rigid foam, which is protected by a suitable covering 18. If a fireproof barrier is desired, construction will involve the use of fireproof materials.

Attachment of the skirt 5 to the boom 1 is provided by a pair of angle members 19 and 20 between which the top edge of the skirt is clamped.

The boom sections are preferably grouped into a number of sub-assemblies thereby limiting the size of the gap, and also limiting the force on individual boom sections. As an example, each sub-assembly might comprise six boom sections. With a clearance of 0.5 inches between each boom section, the maximum gap at any joint will be about 3 inches.

In order for the skirt to accommodate the maximum gap and to form the desired channel 9, the skirt must be elastic and/or the non-attached portion must be provided with a suitable excess length. For a non-elastic material, the top edge portion 8 must have a length greater than the distance between corresponding points on the adjoining boom sections. At the same time, the corresponding excess length at the lower skirt edge may be gathered and secured at 11. The excess channel defining portion may also be in the form of an insert of preformed plastic, such as polypropylene or polyethylene, or thin metal. If the skirt is elastic, some or all of the channel-forming excess length of the top edge of the skirt may be provided by pre-stretching the attached portion, making unnecessary or reducing the amount of the lower edge to be gathered. In either case, it appears that satisfactory operation is achieved when the ratio of channel depth 26, at the non-attached edge 8, relative to the skirt length 27, is from about 1:24 to 1:4, when in operation.

In operation, the tendency of leakage of surface pollutants 21 occurs when water 22 flows relative to the barrier 1. This relative water flow may be due to flow of the water itself and/or due to towing of the barrier. With water flowing relative to the barrier, fluid will necessarily pass through the openings 12 at the boom joints due to the separation and/or non-attachment of skirt portion 8. The non-attached skirt portion 9 channels water flowing through the opening 12 upwardly (23), from below the surface, causing it to well up (24) in the region of the boom joints.

Although the mechanism is not fully understood, it appears that the channeling of wather upwardly, which creates a welling-up effect, prevents floating pollutants 21 being carried through the opening 25.

It was further found that the first-loss speed was higher than that which can be expected from a conventional barrier. Specifically, it was found that the first-loss speed was 1.1 knots compared to 0.9 for a conventional barrier. It appears that the openings 25, by allowing passage of water, reduces the amount of water passing under the skirt, and therefore, raises the velocity at which oil begins being carried under the skirt.

I claim:

1. A barrier for confining floating pollutants comprising:

a plurality of buoyant tubular boom sections serially interconnected by a cable passing longitudinally therethrough;

a flexible skirt, having an upper edge portion and lower edge portion, means attaching the upper edge portion of the skirt to a lower portion of the boom sections except for a portion at the joints to define a non-attached edge portion between adjacent boom sections;

a lower cable member attached to the lower edge portion of the skirt;

said non-attached edge portion of the skirt comprising a portion that is elastic or has a length greater than the distance between corresponding points of the boom sections for forming an upwardly oriented channel, operative, with water passing between the boom sections and non-attached portion of the skirt, to channel water upwardly from below the surface, restricting the passage of floating pollutants.

2. The barrier of claim 1 wherein the non-attached portion has a length greater than the distance between corresponding points of the boom sections in order to form said channel.

3. The barrier of claim 2 wherein any excess length of the lower edge of the skirt below the non-attached portion is gathered and secured.

4. The barrier of claim 1 wherein each boom section comprises a tubular member of buoyant material, a central tubular reinforcing member for receiving said cable, said reinforcing member having a radially extending flange at each end thereof adapted to provide a contacting surface for an adjoining boom section.

5. The barrier of claim 1 wherein the boom sections have complementary ball and socket surfaces at opposite ends.

* * * * *